US005529234A

United States Patent [19]

Juneau

[11] Patent Number: 5,529,234

[45] Date of Patent: Jun. 25, 1996

[54] NAIL DRIVER AND GUIDE TOOL

[76] Inventor: Michael A. Juneau, 202 Wimberly La., Easley, S.C. 29642

[21] Appl. No.: 437,097

[22] Filed: May 5, 1995

[51] Int. Cl.[6] ..... B25C 1/02

[52] U.S. Cl. ..... 227/147

[58] Field of Search ..... 227/110, 113, 227/142, 147, 109

[56] References Cited

U.S. PATENT DOCUMENTS

| | | | |
|---|---|---|---|
| 535,503 | 3/1895 | Kornder | 227/147 |
| 924,054 | 6/1909 | Gehne | 227/147 |
| 952,571 | 3/1910 | Lamb | 227/147 |
| 992,547 | 5/1911 | Crandall | 227/147 |
| 1,089,112 | 3/1914 | Coutant | 227/147 |
| 1,158,430 | 11/1915 | Bell | 227/147 |
| 2,199,833 | 5/1940 | Fleischman | 227/147 |
| 2,672,610 | 3/1954 | Colton | 227/147 |
| 2,839,754 | 6/1958 | Pfaff | 227/147 |
| 2,896,209 | 7/1959 | Hilti | 227/147 |
| 3,060,440 | 10/1962 | Pfaff et al. | 227/147 |
| 3,061,835 | 11/1962 | Hain | 227/147 |
| 3,193,168 | 7/1965 | Weber | 227/147 |
| 3,342,228 | 9/1967 | Reid | 227/147 |
| 3,391,842 | 7/1968 | Mathes | 227/147 |
| 4,437,602 | 3/1984 | Kaczmarek | 227/147 |
| 4,483,475 | 11/1984 | Whitaker | 227/147 |
| 4,676,424 | 6/1987 | Meador et al. | 227/147 |

*Primary Examiner*—Jack W. Lavinder
*Assistant Examiner*—Jay A. Stelacone
*Attorney, Agent, or Firm*—Robert R. Reed; Cort Flint

[57] ABSTRACT

The cost effective hand held tool of this invention has a one-piece housing and a elongated driving piston that can assist the user in driving nails. The piston is made of a metallic material having been magnetized to hold the nail at one end. A striker plate is provided at the first end of the piston for ease of striking by a hammer. The housing is made of an impact resistant nylon that can absorb blows from a hammer without braking. A large hand protecting collar is provided to protect a hand of the user. The tool is indexed to be able to properly position nails of different size within the housing prior to being driven. A two part indexing mechanism is provided by having a plurality of index elements being formed from the housing that engage one of a plurality of index grooves on a length of the elongated piston. Each index groove has an index position to correspond to the standard length of a nail. Index positions are identified by a number to agree with the standard nail designations 6*d*, 8*d*, 10*d* and the like. Metric or other designations can also be used. By setting the piston at an index position, a nail having the size designation is placed in the bore of the housing to contact a second end of the piston. In this position, the nail is guided and will be held approximately flush with the lower end of the housing ready to be driven.

22 Claims, 3 Drawing Sheets

NAIL DRIVER AND GUIDE TOOL

BACKGROUND OF THE INVENTION

This invention relates to hand held tools for driving nails, and more particularly to a cost effective device which is simple and reliable due to a few number of parts to protect the hand and accurately guide the nail being driven by an elongated indexed piston.

Numerous nail driving and guiding devices have been used and are long known in the art. The importance of these and improved devices has increased over the past few years due to the rapid growth of the number of home owners and others doing their own construction work. These do-it-yourself owners and amateur carpenters have much difficulty in holding and guiding a nail to be driven. The probability of striking themselves somewhere on their body is very high. The increased medical costs resulting from accidents has made the purchase of protection devices much more cost effective in recent years. In addition, the easier the tool is to use, and the more it instructs the user in its use, the better. The hand held tool of this invention provides such a device.

Typical nail guiding and driving tools invented over the years are disclosed in U.S. Pat. Nos. 535,503, 924,054 and 4,676,424. In U.S. Pat. No. 535,503 a pair of spring controlled arms hold a nail as it is being driven by a plunger. The plunger is inserted into a tube that guides the plunger and holds the arms that support the nail. The end of the nail is not indexed to the end of the arms prior to driving the nail.

The disclosure of U.S. Pat. No. 924,054 shows a nail driving plunger with a variable diameter slidably mounted in a tubular body with a channeled guiding member at one end. A thumb piece is located in the tubular body to control the location of the plunger within the tubular body. The striking surface is at the end of the plunger being an relatively small area for striking. A number of individual pieces are used to make the tubular body. A similar tool is disclosed in U.S. Pat. No. 4,676,424 that also includes a pin to limit the movement of a punch in a metal sleeve. The movement of the punch is further controlled to not drive the nail more than necessary into an object being nailed. The punch includes a head adapted to receive direct blows. The tool of this invention works best with a single nail size.

A number of prior art tools have guide sleeves in the form of handles shaped for gripping with one hand. Two such references are U.S. Pat. Nos. 2,839,754 and 3,391,842. In U.S. Pat. No. 2,839,754 a flexible housing encompasses a steel guide member having an axial bore with a striker rod mounted within the bore. A tubular friction member attached to the striker rod is placed between the flexible housing and the steel guide member. A hand guard of limited width beyond the housing is a part of the flexible housing. The shank of a fastener or nail is gripped with a guide arrangement and the position of the fastener during driving is indicated by indices on the periphery of the tubular friction member. No indexing for different size fasteners is indicated. The tubular friction member frictionally absorbs the rebounds of the driving punch by gripping the housing.

The patent of U.S. Pat. No. 3,391,842 discloses a guide sleeve in the form of a handle which is provided with a projection to provide some limited protection for the hand of the operator. In another embodiment a separate handle portion is made to offset the handle portion containing a driver. The driver is supported and stopped in its driving motion by a tubular extension placed within the handle.

Discrete plunger or piston retainer devices are disclosed in U.S. Pat. Nos. 952,571; 992,547; 1,089,112; 1,158,430; 2,199,833; 2,672,610; 2,896,209; and 4,437,602. A body or barrel portion provides the outer housing for the plunger in U.S. Pat. No. 922,547, 1,089,112 and 1,158,430. As disclosed in each of these patents, the movement of the plunger within the barrel portion is limited by a ratchet device where an engaging device attached to the barrel engages the ratchet grooves on the plunger. The ratchet grooves are closely spaced and the spacing is not associated with the size of different fasteners being driven.

Friction devices to keep the plunger or driver engaged in the barrel or housing are disclosed in U.S. Pat. No. 952,571; 2,199,833; 2,896,209; and 4,437,602. Each of these patents disclose some type of friction device attached to the housing that holds a shank portion of the driver within the housing at various positions when the fastener is being driven. The shank is held by the friction alone without grooves or other holding components. The U.S. Pat. Nos. 952,571, 2,199,833 and 2,896,209 also disclose an additional means to hold the fastener as it is being driven.

In U.S. Pat. No. 2,672,610 discloses a combined nail driver and set for finish nails which has a spring wire which cooperates with an indicator groove to indicate the distance that the finish nail has been set below the surface of the wood. There is no indication as to the starting position for driving the finish nail.

The present tools provide only limited assistance in driving a nail and numerous components are used to make the tool. Most of these tool components are easily damaged by a misguided blow of the hammer and they require adjustments and maintenance. Striking surfaces are often very small causing more misguided blows to occur. Little protection is also provided for the hand of the operator. No indicating means to properly position different sizes of nails is provided prior to the start of the driving operation. A need exists to have a minimum number of impact resistant components which can be economically manufactured and can be operated to protect the user. A tool that helps the user adjust for different sizes of nails is also needed.

Accordingly, an object of the present invention is to provide a simple, reliable and cost effective hand held tool for driving nails and at the same time instruct the user as to a proper initial setting for different sizes of nails.

Another object of the present invention is to provide a hand held tool that has a portion to protect the hand of a user from being hit when the nail is being driven. A tool that can be safely held in a correct position by one hand when driving the nail from almost any position is also part of this object.

Yet another object of the present invention is to provide a hand held tool which has a striking surface which is easily struck by a hammer or other driver device. In addition, if the tool is struck by the hammer, the object is to have essentially no damage to the tool.

SUMMARY OF THE INVENTION

The above objectives are accomplished according to the present invention by providing a hand held tool having a one-piece housing made of impact resistant nylon and a metallic elongated piston which is magnetized to hold the nail to be driven.

The hand held tool of this invention is for guiding and driving nails of different size with a hammer. The tool comprises a one-piece molded housing having a hand grip portion, a collar portion and a nail guiding portion with a hollow bore. A plurality of resilient index elements are molded into the housing and surround the bore in a manner that the index elements project resiliently into the bore. An elongated driver piston is slidably carried within the bore. A plurality of index grooves are spaced along a length of the driver piston and the resilient index elements resiliently engage the index grooves for indexing a respective nail for driving.

In another embodiment the invention includes a hand held tool for guiding and driving a nail with a hammer. The invention comprises a single piece housing with a hand protecting collar carried near an upper end of the housing. Underneath the collar a user can position a hand and protect the hand from being struck by the hammer. The invention further comprises an elongated driver piston carried in the housing having a first end accessible for striking with the hammer and a second end for contacting and driving the nail. An elongated sleeve of the housing defines a hollow bore extending along a length of the housing to contain the elongated piston and guide the nail at a lower end. A plurality of index grooves are spaced along a length of the elongated driver piston. Resilient index elements are formed within the upper end of the housing for engaging the index grooves of the elongated piston and holding the elongated piston at least at the index grooves during driving of the nail.

In a further embodiment the invention comprises a single piece housing having a hand grip portion and a guiding portion. An elongated driver piston is carried in the housing having a first end accessible for striking with the hammer and a second end in contact with the nail. The guiding portion of the housing includes an elongated sleeve having a hollow bore extending a length of the housing to contain and guide the elongated piston and the nail. An indexing mechanism acting between the piston and the housing retains the elongated piston partially within the bore of the housing in a plurality of index positions. The index positions are spaced generally according to standard nail lengths so that a terminal end of a standard nail inserted in the bore at a lower end of the housing is in a proper nailing position with respect to the lower end when the elongated driving piston is set in a corresponding index position.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail. An essential component of the hand held tool is a housing that can be gripped by one hand of the operator and can hold a nail in a correct position and help guide the nail in preparation for the nail to be driven into the object to receive the nail. Another essential component of the hand held tool is an elongated driver piston that can be easily struck with a hammer to drive the nail and is magnetized to hold the nail before it is driven. These essential components have an essential indexing mechanism between them that allows different size nails to be properly positioned before being driven. The housing protects the hand of the operator and is cast from a single piece to make it impact resistant and economical to manufacture.

Figure 1:
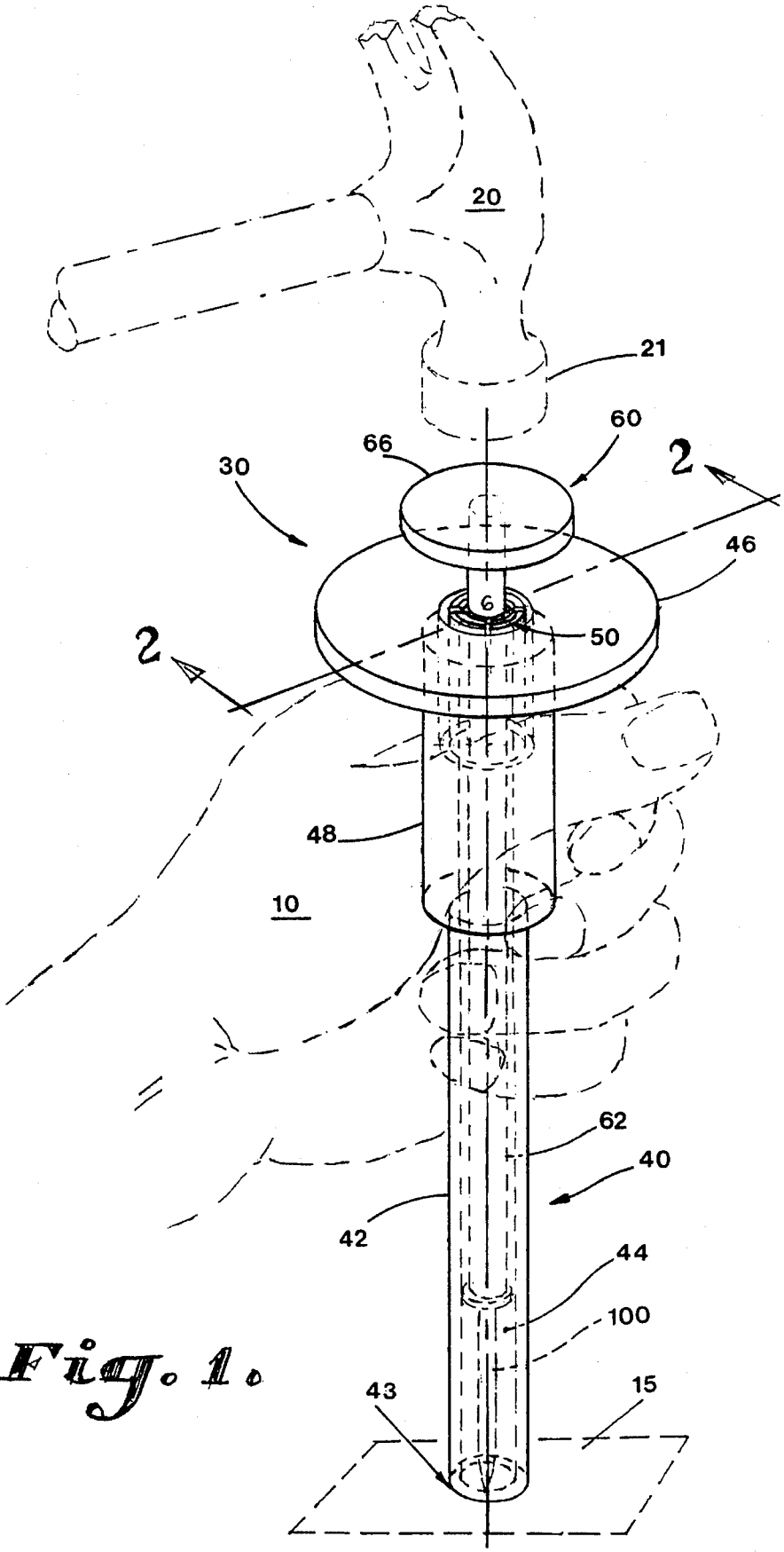
FIG. 1 is a perspective view of the tool of this invention illustrating its use by being held by a hand of the operator and in a position to be struck by a hammer.

A hand held tool 30 of this invention in a position for driving a nail is illustrated in FIG. 1. A housing 40 is gripped by one hand 10 and positioned to contact a surface 15 of an object that is to receive a nail 100. The single piece housing 40 has a hand protecting collar 46 near an upper end portion 48 of the housing. An elongated driver piston 60 has a striker plate 66 at a first end 61 that is struck by a head 21 of a hammer 20. An elongated shaft 62 of the piston extends within a bore 44 of an elongated sleeve 42 of the housing to contact the nail 100 and transfer the force of the hammer to the nail. An indexing mechanism 50 acting between the housing 40 and the piston 60 retains the elongated piston partially within the bore of the housing in a plurality of index positions. The index positions are spaced generally according to standard nail lengths so that a terminal end of the nail is known to be at the end of the housing ready to be driven. For example, an index position (number 6) has been indexed by the indexing mechanism to be visible at the upper end of the housing. This index position has been chosen in preparation for driving a standard **6*d* size nail (2 inches long) into the surface 15**.

Figure 2:
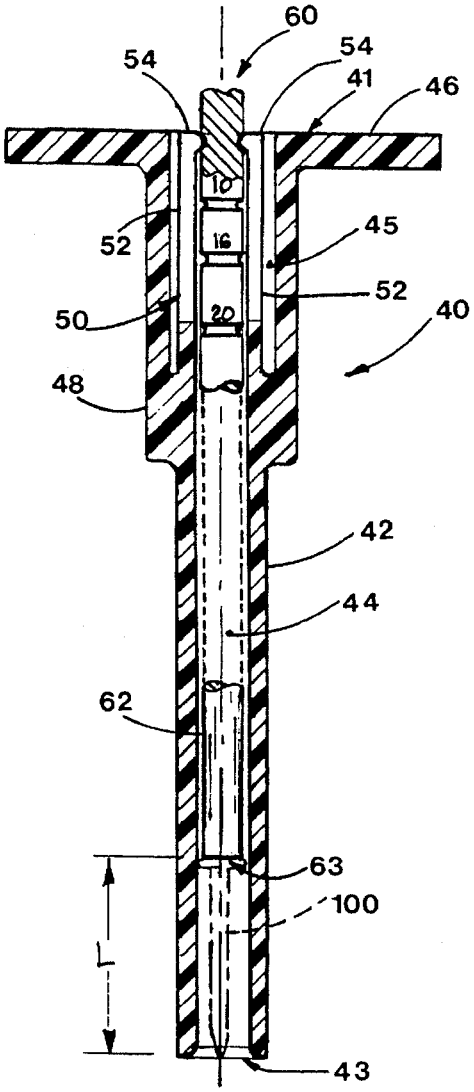
FIG. 2 is a cross-sectional view of the hand held tool of this invention taken along line 2—2 shown in FIG. 1.

The position of the elongated driving piston 60 within the hollow bore 44 of the housing 40 is best illustrated by the cross-sectional view of FIG. 2. The hollow bore 44 has a diameter large enough for the elongated shaft 62 of the piston to freely move within the bore. A second end 63 of the shaft is in contact with the nail and the piston 60 is magnetized to hold the nail in contact with this end. The bore diameter is determined by the size of the head of the nail 100. A common nail will have head diameter much larger than the head diameter of a finish nail but much smaller than the head diameter of a spike. The bore diameter along with the diameter of the elongated shaft can vary to accommodate the diameter of the nail head within the scope of this invention. However, the preferred tool has a constant diameter for a particular class of nails. The economical design of the hand held tool of this invention will allow the operator to purchase a number of tools with different bore diameters. Preferred bore diameters for the tool of this invention include a range of diameter values from about 0.100 inch for finish nails to about 0.400 inch for spikes. Other bore diameters are also possible within the scope of this invention.

Figure 3:
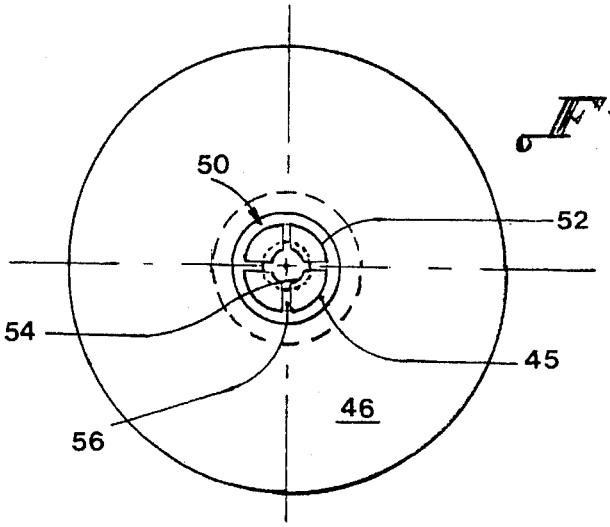
FIG. 3 is a top plan view of the hand held tool of this invention with the piston removed.

The elongated shaft 62 is held in position within the bore 44 by an indexing mechanism 50 as illustrated in FIGS. 2 and 3. The indexing mechanism includes a first indexing part carried by the elongated piston 60 and a second indexing part carried by the housing 40. The second indexing part of the indexing mechanism is made adjacent the upper end 41 of the housing 40. The second indexing part is formed by initially making a cylindrical cutout 45 to form a cylinder that surrounds the bore 44 of the housing. A plurality of resilient index elements 52 are formed by making radial cuts 56 in the cylinder previously formed by the cylindrical cutout. There are preferably four radial cuts to form four resilient index elements. Each index element has a projection 54 that extend radially into said bore. The projections contact and hold the elongated driver piston 60 at a plurality of index positions.

Figure 4:
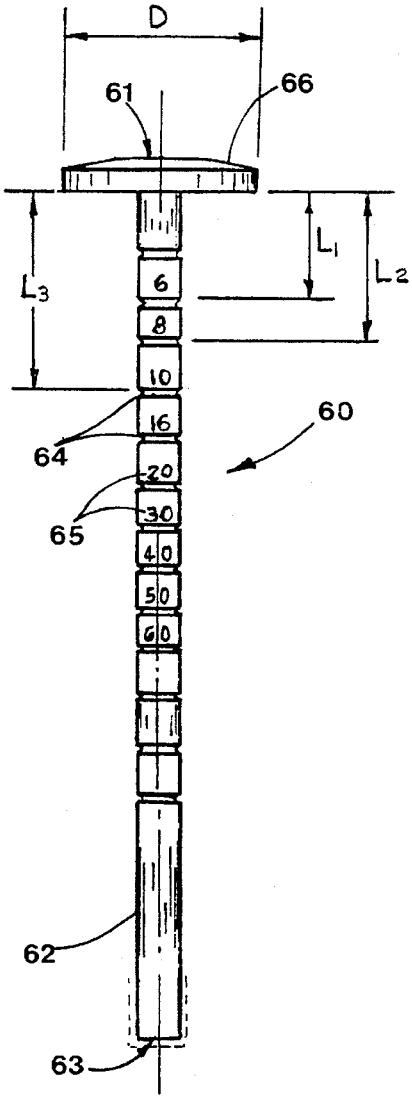
FIG. 4 is an elevation view of the elongated driver piston component of the hand held tool of this invention.

The first indexing part of the indexing mechanism 50 includes a plurality of spaced apart index grooves 64 that define a plurality of index positions 65 on the elongated piston 60, as illustrated in FIG. 4. Once again, the first end 61 of the elongated piston has the striker plate 66 for receiving blows from the hammer and the second end 63 of the elongated piston is in contact with a nail. The striker plate contacts the upper end 41 of the housing 40 when the second end 63 of the piston is adjacent the lower end 43 of the housing and the nail has been driven. The index grooves 64 are located at various lengths L1, L2, L3, etc. from the striker plate 66. For example, the lengths L1, L2 and L3 provide index locations #6, #8, and #10 respectively. These index positions further correspond to nails having size designations of **6*d*, 8*d* and 10*d* which are 2.0 inches, 2.5 inches and 3.0 inches respectively. The preferred index grooves are spaced ½ inch apart to accommodate nail sizes from 4*d* to at least a nail size of 60*d***. Other standards, such as metric standard sizes or any other national or international standard, can also be used to determine another spacing of the index grooves to provide index positions according to this invention.

The indexing mechanism works such that the first indexing part, being a respective index groove 64, is engaged by the projections 54 of the second indexing part, being index elements 52. With a nail 100 of given length L (FIG. 2) made to corresponding with a first length of the elongated sleeve 42 from a second end 63 of said elongated shaft 62 to a lower end 43 of the sleeve, the indexing mechanism is set to make a first length of said elongated piston 60 between said striker plate 66 of the piston and the upper end 41 of the housing also equal to length L. The index positions 65 (FIG. 4) allow this to be easily determined from the known nail size. This is referred to herein as indexing the hand held tool for the nail size being driven. This is a unique and special feature of the tool of this invention. Indexing allows the nail to be in a generally most desired position for guiding the nail at the start of the driving operation. The placement of the lower end 43 of the housing 40 to be flush with the surface 15 of the object receiving the nail (FIG. 1) helps in guiding the nail. The hand held tool 30 of this invention can be used in an inverted position for nailing an object overhead, or in any other position.

The elongated piston 60 is also supported within the hollow bore 44 by the index elements 52 when the piston is in a position where the projections 54 are not engaging a respective index groove 64. The resilient index elements move radially to disengage the respective index groove as a result of the driving force of the hammer on the striker plate 66 of the piston. However, there remains a force between the elongated shaft 62 of the piston and the projections 54 of the resilient index elements 52 sufficient to hold the piston 60 in any non-indexed intermediate position between index grooves 64.

Figure 5:
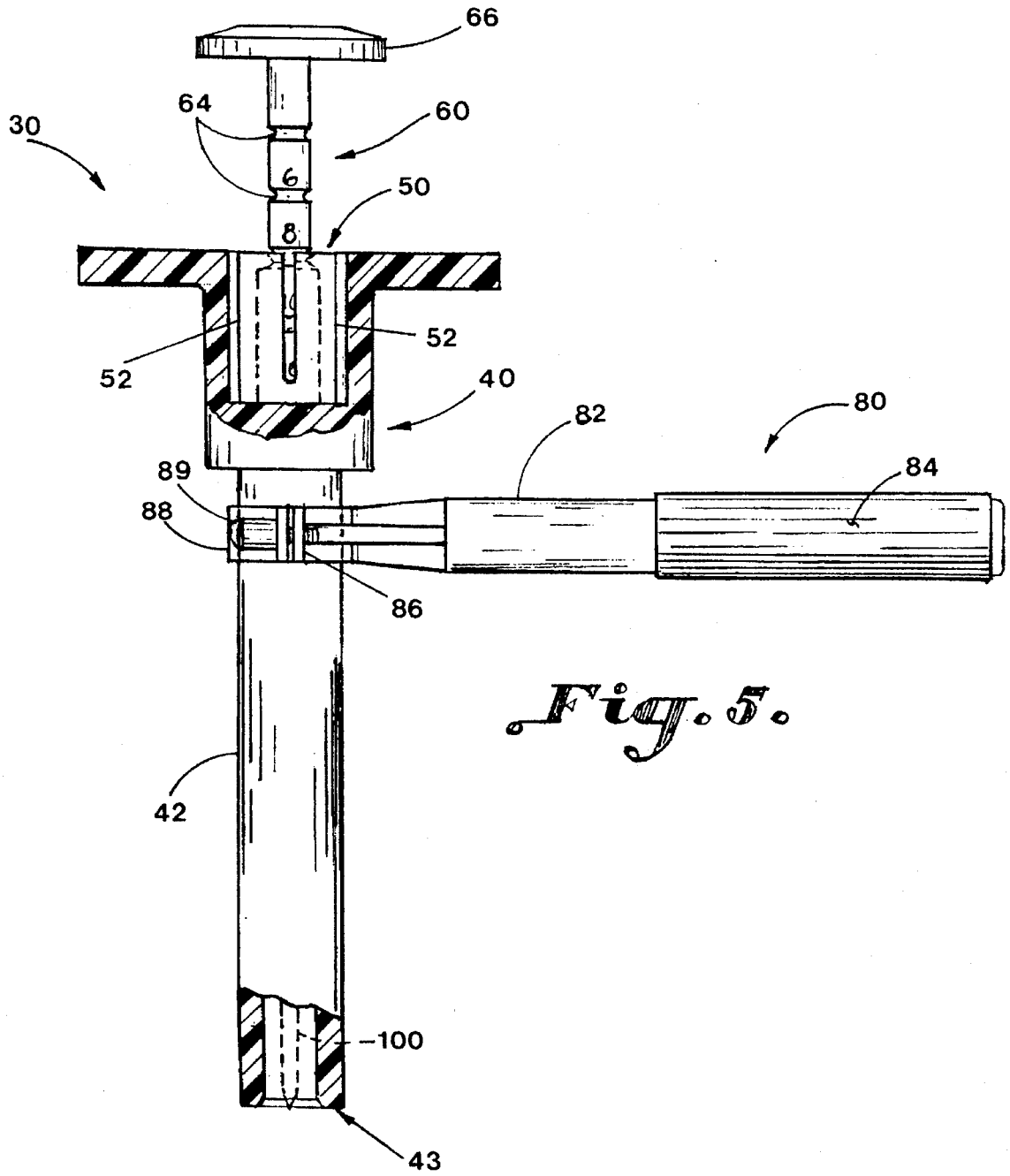
FIG. 5 is an elevation view of the tool of this invention with partial cutout sections to show details of the tool and with an attached handle to alternately support the tool when being held by the hand of an operator.
Figure 6:
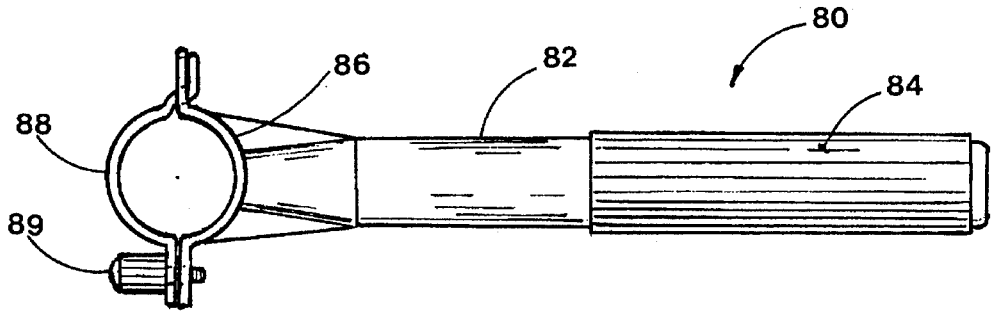
FIG. 6 is a plan view of the handle embodiment of the hand held tool of this invention.

To assist in providing the most convenient use of the hand held tool 30 an alternate embodiment of this invention includes a handle 80 as illustrated in FIGS. 5 and 6. The handle includes a handle shaft 82 and a pair of straps 86 and 88 to be placed around the elongated sleeve 42 of the housing 40. A surface layer 84 is provided to allow the operator to improve gripping of the handle shaft 82. The straps secured the housing by a screw attachment 89. Any other convenient method for securing the handle to the housing is within the scope of this invention. The indexing mechanism 50 continues to function in the same manner with the resilient index elements 52 engaging one of the index grooves 64 of the elongated piston 60 such that the nail 100 has its lower end at the lower end 43 of the housing. The index positions 10,16,20 are again used to correspond with the size of the nail; with index position #8 shown as being indexed. The handle 80 of this embodiment allows the operator to keep the striker plate 66 of the piston at an increased distance from his body when necessary. The arm of the operator can be in an outstretched position with this embodiment in lieu of a bent position required to grip the elongated sleeve and drive the nail with the other hand at the same time.

While a preferred embodiment of the invention has been described using specific terms, such description is for illustrative purposes only, and it is to be understood that changes and variations may be made without departing from the spirit or scope of the following claims.

What is claimed is:

1. A hand held tool for guiding and driving nails of different nail sizes and lengths into an associated structure with a hammer comprising:

a single piece housing;

a hand protecting collar carried near an upper end of said housing underneath which a user can position a hand and protect said hand from being struck by said hammer;

an elongated driver piston carried in said housing having a first end accessible for striking with said hammer and a second end for contacting and driving a nail;

an elongated sleeve of said housing defining a hollow bore extending along a length of said housing to contain said elongated piston and guide said nail at a lower end of said housing;

a plurality of index grooves axially spaced along a length of said elongated driver piston, each said index groove corresponding to a starting position of said driver piston within said hollow bore of said housing for a corresponding one of said nail lengths; and resilient index elements being formed within said upper end of said single piece housing for sequentially engaging said index grooves of said elongated piston and holding said elongated piston at one of said index grooves and starting positions for a selected one of said nails prior to driving of said nail so that said first end of said driver piston is displaced away from said housing in a desired position for driving said nail, and said index elements releasing said piston from said starting position upon said first end of said driver piston being struck by said hammer for driving said nail in said associated structure.

2. The hand held tool of claim 1 including:

a first length of said elongated driver piston defined between a striker plate at said first end of said piston and said protecting collar of said housing;

a first length of said elongated sleeve defined between said second end of said piston and said lower end of said housing; and said first length of said elongated sleeve being equal to both said first length of said elongated driver piston and said length of said one nail when said index elements are engaged in said starting position of said elongated driver piston.

3. The hand held tool of claim 1 including a width of said protective collar measured laterally outward from said upper end portion of said housing to protect an area of the hand of an operator, that includes a thumb and an index finger when in a first gripping configuration around said elongated sleeve, from being struck by said hammer when said elongated sleeve is being gripped by said hand and said hammer is used to strike said elongated driver piston.

4. The hand held tool of claim 1 including an enlarged striker plate at said first end of said elongated piston having a diameter larger than a head of said hammer to allow said hammer head to easily engage said striker plate when said nail is being driven.

5. The hand held tool of claim 4 wherein said diameter of said striker plate has a value in the range of about 0.30 inch to about 1.50 inches.

6. The hand held tool of claim 1 wherein said driver piston is made from a steel alloy material and is magnetized to allow said nail to be held by magnetic forces in contact with said second end of said elongated driver piston before being driven.

7. The hand held tool of claim 1 including a handle attached to said elongated sleeve to provide a second location that can be gripped by a hand of an operator to position said tool in a desired location for driving said nail.

8. The hand held tool of claim 1 wherein said single piece housing is made of an flexible impact nylon material.

9. The hand held tool of claim 1 wherein each one of said index elements includes a radial projection for engaging said index grooves and for contacting said elongated piston between adjacent index grooves of said plurality of index grooves to hold and guide said piston within said hollow bore.

10. The hand held tool of claim 1 wherein said index grooves are spaced approximately ½ inch apart along the length of said driver piston to correspond to said different nail lengths.

11. A hand held tool for guiding and driving nails of different nail sizes and lengths into an associated structure with a hammer comprising:

a single piece housing having a hand grip portion and a guiding portion;

an elongated driver piston carried in said housing having a first end accessible for striking with said hammer and a second end for contacting a nail when driven;

said guiding portion of said housing including an elongated sleeve having a hollow bore extending a length of said housing to axially contain and guide said elongated driver piston and said nail to be driven;

said hollow bore terminating in a discharge opening through which said driven nail is discharged when driven;

an indexing mechanism acting between said driver piston and said housing to retain said elongated driver piston within said bore of said housing at one of a plurality of axially spaced index positions;

each of said index positions corresponding to a starting position of said driver piston for driving a corresponding one of said nail lengths; and said driver piston being axially positioned in said housing at one of said starting positions for a selected one of said nails prior to driving of said one nail so that said second end of said driver piston is axially displaced away from said discharge opening by a distance which is generally equal to said length of said one nail.

12. The tool of claim 11 wherein said indexing mechanism includes a first indexing part carried by said elongated piston and a second indexing part carried by said housing that engages with said first indexing part.

13. The tool of claim 12 wherein said first indexing part comprises a plurality of spaced index grooves and said second indexing part comprises a plurality of resilient index elements each with a projection for engaging a one of said index grooves.

14. The tool of claim 11 wherein an upper end of said housing has a cylindrical cutout to form a cylinder that surrounds said bore at said upper end of said housing.

15. The tool of claim 14 wherein said indexing mechanism includes a plurality of axially spaced indexes carried on said elongated piston and corresponding to said plurality of index positions;

a plurality of resilient index elements formed by a plurality of radial cuts made in said cylinder; and said resilient index elements being deflectable radially with respect to said bore to engage one of a plurality of index grooves of said elongated piston at said corresponding one of said plurality of index positions to hold said piston within said guiding portion of said housing.

16. The tool of claim 15 wherein said index elements each have a projection extending radially into said bore, said projections contact and hold said indexes of said elongated piston at said index positions.

17. The tool of claim 15 wherein said index elements each have a projection extending radially into said bore, said projections being deflectable radially to grip and hold said elongated driver piston within said bore of said guiding portion when said elongated piston is in a position within said bore of said guiding portion such that said projections are axially positioned between said index grooves of the driving piston.

18. The tool of claim 11 wherein said indexing mechanism includes a first indexing part carried by said elongated piston spaced apart to define said index positions, and a second indexing part carried by said housing that engages said first indexing part.

19. The tool of claim 18 wherein said first indexing part comprises a plurality of index grooves and said second indexing part comprises a plurality of resilient index elements each having a projection for engaging a one of said grooves.

20. A hand held tool for guiding and driving nails of different nail sizes and lengths into an associated structure with a hammer comprising;

a one-piece molded housing having a hand grip portion, a collar portion and a nail guiding portion with a hollow bore;

at least one resilient index element molded into said housing in a manner such that said index element projects radially and resiliently into said bore;

an elongated driver piston slidably carried within said bore for driving a selected one of said nails upon being struck by said hammer;

a plurality of index grooves spaced along a length of said driver piston; and said at least one resilient index element resiliently and sequentially engaging said index grooves to define a series of starting positions from which said nails are driven depending on the length of a selected nail to be driven.

21. The tool of claim 20 wherein said one-piece molded housing includes said collar being molded to have a width sufficient to protect a fist area of a hand of an operator.

22. The tool of claim 20 wherein at least one resilient index element includes a plurality of resilient index elements molded into said housing and segmentally surrounding said bore in a manner such that said index elements project radially and resiliently into said bore.

* * * * *